United States Patent [19]

Gibson

[11] 4,122,798

[45] Oct. 31, 1978

[54] APPARATUS FOR COATING THE INTERIOR OF TUBULAR GOODS

[76] Inventor: Jack E. Gibson, 4905 Pepperidge Pl., Odessa, Tex. 79761

[21] Appl. No.: 795,127

[22] Filed: May 9, 1977

Related U.S. Application Data

[63] Continuation of Ser. No. 704,965, Jul. 13, 1976, Pat. No. 4,089,998.

[51] Int. Cl.[2] ..... C23C 13/08; B05C 7/04

[52] U.S. Cl. ..... 118/50; 118/56; 118/408; 118/409; 118/DIG. 5; 427/182

[58] Field of Search ..... 118/56, 408, 409, DIG. 5, 118/DIG. 10, 50; 427/182, 183, 231, 238

[56] References Cited

U.S. PATENT DOCUMENTS

| | | | |
|---|---|---|---|
| 2,953,157 | 9/1960 | Osborne et al. | 118/DIG. 10 |
| 3,039,428 | 6/1962 | McLean | 118/DIG. 10 |
| 3,207,618 | 9/1965 | DeHart | 427/182 |
| 3,218,184 | 11/1965 | Lemelson | 118/408 X |
| 3,869,300 | 3/1975 | Scheiber | 427/182 |
| 3,982,050 | 9/1976 | Kato et al. | 427/182 X |

*Primary Examiner*—Wm. Carter Reynolds
*Attorney, Agent, or Firm*—Marcus L. Bates

[57] ABSTRACT

The interior of a pipe is coated with a uniform thickness of plastic. A fluidized bed of heat-meltable plastic material in particular form is connected to the inlet end of the pipe, while the opposed end of the pipe is made attachable to a source of reduced pressure. A source of compressible fluid is also connected to the inlet end of the pipe. The pipe is preheated and then rotated axially while the compressible fluid flows therethrough. The compressible fluid flowing to the inlet is suddenly terminated while a flow from the fluidized bed is immediately established so that the vacuum at the outlet end of the pipe causes uninterrupted mass flow and pulls a finite pocket of the finely divided plastic into the pipe. The flow of particular plastic material is terminated, while the flow of compressed gas is immediately reestablished, thereby pushing the pocket of plastic material into and through the pipe. Timing means associated with the flow from the fluidized bed enables the vacuum source to be removed before the pocket of material arrives at the outlet end of the pipe. This sequence of manipulative steps applies a coating of plastic material on the interior surface of the spinning pipe. The spinning action, together with the elevated temperature of the pipe, enhances the uniformity of the deposited plastic material.

9 Claims, 8 Drawing Figures

FIG. 8

APPARATUS FOR COATING THE INTERIOR OF TUBULAR GOODS

RELATED PATENT APPLICATIONS

This patent application is a continuation of Patent Application Ser. No. 704,965, filed July 13, 1976, now Pat. No. 4,089,998, entitled "Method of Powder Coating the Interior of Tubular Goods".

BACKGROUND OF THE INVENTION

It is known to coat the interior of metal pipes by forcing entrained particles of plastic to flow through a preheated, rotating pipe. DeHart, U.S. Pat. No. 3,207,618, discloses apparatus and method by which a fluidized bed of plastic particles are passed into a pipe in order that the particles may adhere to the interior sidewall thereof and bond to one another and to the surface of the pipe, to provide a continuous coating. The Dehart disclosure suggests duplicate equipment arranged at opposed ends of the pipe so that the entrained plastic can be flowed through the pipe in a first direction and thereafter flowed through the pipe in a reverse direction, thereby providing a more uniform coating on the interior of the pipe. Moreover, DeHart employs a separator and a vacuum combination at the outflow end of the pipe.

Stallard, U.S. Pat. No. 3,532,531, is similar to the DeHart disclosure, and additionally supercools the plastic particles prior to forcing the particular plastic to flow into the rotating pipe.

Blackburn, U.S. Pat. No. 2,919,160, discloses apparatus for dispending powdery materials wherein a fluidized bed of pulverulent material is transferred to a mold.

Condo et al, U.S. Pat. No. 3,814,616, places a pipe to be coated within an oven and coats the interior thereof by sucking air into one end while feeding negatively charged, dry particles of a coating composition into the other end.

Randell, U.S. Pat. No. 2,758,546; Dalley et al, U.S. Pat. No. 1,997,761; DeHart, U.S. Pat. No. 3,207,618; Star et al, U.S. Pat. No. 3,208,869; Church, U.S. Pat. No. 3,108,022; and Weidenhammer et al, U.S. Pat. No. 3,260,611, are further examples which set forth known prior art expedients which involve the handling of particulated plastic and the deposition of the plastic onto a wall surface in order to form a coating. Reference is made to the above issued patents, and to the art cited therein, for further background of this invention.

In actual practice, so far as Applicant can determine, these and other presently known processes for coating the interior of metal pipe fail to provide a coating of substantial uniform thickness. It is for this reason that some processes require that the pipe be twice treated by flowing the plastic material in one direction through the pipe, and thereafter flowing the material through the pipe in an opposite direction, thereby laying down two separate coatings in order that the thickness of the coating will not unduly diminish from one end to the other of the pipe. These and some other known processes require reprocessing as much as 30 percent of the completed pipes because the coating is unsatisfactory.

After a pipe has been coated and tested, should the coating fail to measure up to acceptable standards, the coating must be removed and the pipe returned for reprocessing. Usually the coating is burned out or oxidized by utilizing a flame on the interior thereof. The reprocessing of unsuitable pipe is expensive.

It would therefore be desirable to be able to apply a protective plastic coating to the interior of the pipe in such a manner that the coating is uniform from one end of the pipe to the other and about the entire inside peripheral surface of the pipe, while at the same time, the process of coating is carried out in such a manner that very few of the pipes must be reprocessed.

SUMMARY OF THE INVENTION

Method and apparatus for coating the interior of an elongated, hollow member by flowing particulated, synthetic, polymeric material from a fluidized bed into the pipe. The member to be coated is heated to a temperature above the softening temperature of the polymeric material and thereafter rotated about the longitudinal axis thereof at an angular velocity which causes any polymeric material adhering to the interior surface to form a uniform coating about the entire inside peripheral wall surface thereof.

In the preferred embodiment of the invention, the inlet end of a pipe is connected in parallel relationship to a fluidized bed of the polymeric material and to a source of compressed gas such that the inlet end of the pipe can be immediately and selectively connected to either the fluidized bed or to the compressed gas source. The outlet end of the pipe is removably connected to a suction means.

The pipe is cleaned and preheated, and then rotated at an angular velocity sufficient to cause a particle of melted plastic to flow in all directions to thereby coat the pipe interior.

Flow is first established to connecting the inlet end of the pipe to the compressed gas, while the outlet end is connected to the suction. The compressed gas source is terminated while the flow from the fluidized bed is instantaneously initiated so that the mass flow through the pipe is augmented by the suction for a timed interval. This expedient injects a pocket of air-entrained particles of plastic into the pipe. The flow from the fluidized bed is terminated and the flow from the compressed gas immediately re-established to thereby push the pocket of plastic material through the pipe.

Means are provided by which the suction is removed from the outlet end of the pipe before the pocket of plastic material emerges therefrom.

The pipe continues spinning for a sufficient length of time to spread the melted, adhering particles of plastic into a continuous film.

Accordingly, a primary object of this invention is the provision of both method and apparatus for applying a continuous coating of plastic to the interior of a pipe.

Another object of the invention is to provide a pipe coating process wherein a flow of compressible gases through the pipe is interrupted by a flow of particulated plastic material for a finite length of time, after which the flow of compressible gases is immediately resumed, thereby causing a pocket of gas-entrained particles to flow down through the pipe as the particles adhere to the interior wall where they are melted, and subsequent centrifugal force forms a continuous film about the entire inner peripheral wall surface of the pipe.

A further object of this invention is to disclose and provide a pipe coating process wherein a preheated spinning pipe has an outlet end thereof connected to a suction means so that compressible gas is forced to flow through the pipe. At the same time, compressed gas is forced to flow into the inlet end of the pipe. As the mass flow proceeds through the pipe, a flow of air-entrained plastic particles is substituted therefor; and thereafter, the flow of air-entrained plastic particles is terminated, and immediately thereafter the flow of compressed gas resumed. The suction is removed from the outlet end of the pipe before the pocket of plastic particles emerges therefrom.

A still further object of this invention is to provide a method for coating hollow, elongated members, comprising producing a continuous flow of compressible fluid through the pipe, which includes a pocket of gas-entrained plastic particles therein, and applying a suction at the outlet end of the pipe during the time interval that the plastic is being injected thereinto, and resuming the flow of compressed gases after removing the suction before the plastic particles emerge therefrom.

Another and still further object of this invention is the provision of apparatus which includes electrical circuitry by which a rotating heated pipe has a mass flow of compressed gases established therethrough, and a pocket of gas-entrained plastic particles is caused to flow in series relationship with the compressed gas flow to thereby enable the particles to contact and adhere to the sidewall of the pipe.

These and other objects and advantages of the invention will become readily apparent to those skilled in the art upon reading the following detailed description and claims and by referring to the accompanying drawings.

The above objects are attained in accordance with the present invention by the provision of method and apparatus fabricated in a manner substantially as described in the above abstract and summary.

DETAILED DESCRIPTION OF THE PREFERRED EMBODIMENT

Throughout the various figures of the drawings, wherever it is possible or logical to do so, like numerals generally refer to like or similar parts.

Figure 1:
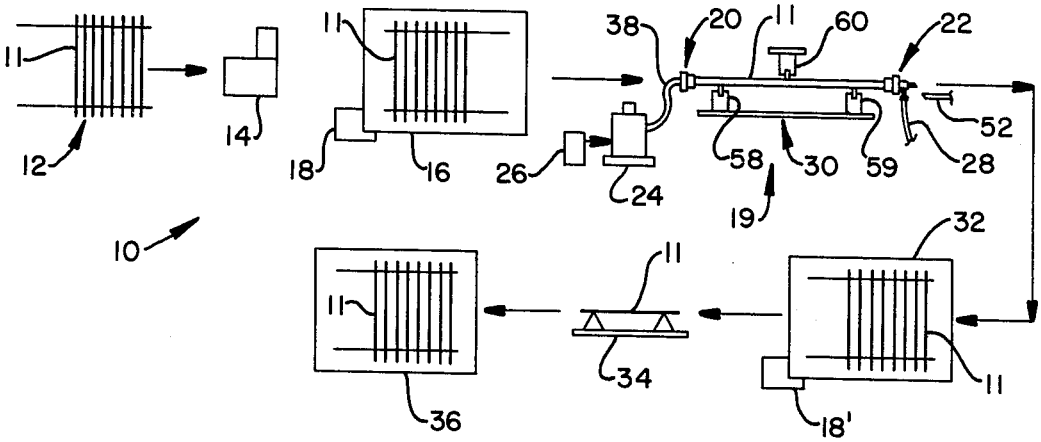
FIG. 1 is a part diagrammatical, part schematical illustration of a process for coating elongated tubular members in accordance with the present invention.

FIG. 1 diagrammatically discloses a process 10 for coating the interior of an elongated member, such as a pipe, with a continuous uniform coating of plastic. The process commences with individual joints of used or new pipe 11 which is stored in a conventional manner, such as a pipe rack 12, for example, so that the pipe can be continuously fed in series relationship into a cleaning device 14. The cleaning device generally is a sandblasting apparatus; or alternatively, a shotpeening device wherein the interior of the pipe is subjected to a cleaning action according to prior art expedients.

The pipe continues into an oven 16 where the temperature thereof is elevated to approximately 410° F. by any conventional heating means 18.

The hot pipe is next conveyed to a coating station 19. A removably swivel coupling 20 and 22, respectively, are attached to the inlet and outlet ends, respectively, of the pipe. Apparatus 24 contains a fluidized bed of plastic particles and preferably is connected by a flexible conduit to the coupling 20. A source of compressed gas 26, preferably air, is connected to the fluidized bed apparatus.

Suction means 28 is connected to the connector 22 so that a suction can be pulled on the outlet end of the pipe. Apparatus 30 supports the pipe in a rotatable manner so that the pipe can be rotated about its longitudinal axis at a rotational velocity which produces sufficient centrifugal force to cause the heated plastic particles to flow into a continuous uniform coating.

The threaded ends of the pipe is sometimes coated manually and the pipe thereafter conveyed to a curing oven 32 where the pipe is baked until the coating is curved. This step of the process is sometimes eliminated where the characteristics of the coating do not demand baking.

The pipe is next conveyed to a rack means 34 where the interior of the pipe is inspected by utilizing equipment known to those skilled in the art. The finished product is stored at 36 until it is needed.

Figure 2:
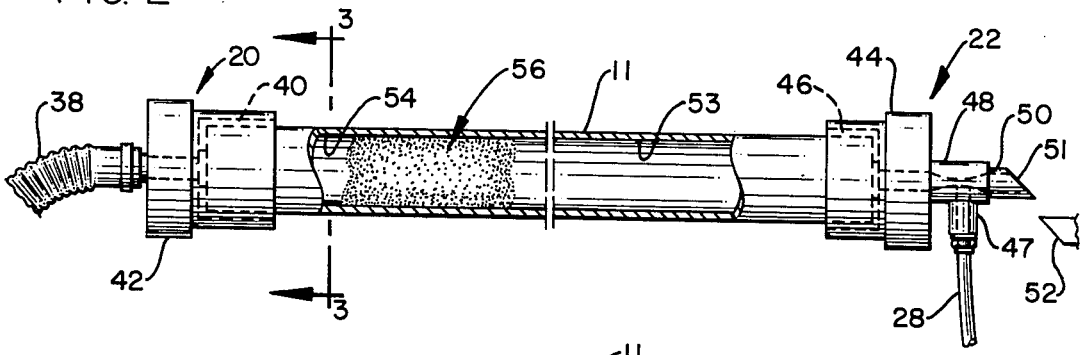
FIG. 2 is an enlarged, side elevational view of part of the apparatus disclosed in FIG. 1, with some parts thereof being cut away and some of the remaining parts being shown in cross section.
Figure 3:
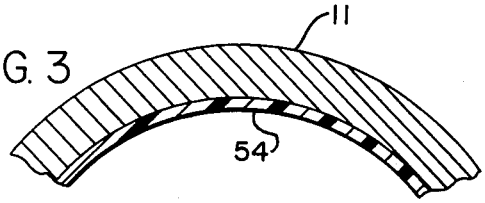
FIG. 3 is a fragmented, enlarged, part cross-sectional view taken along line 3—3 of FIG. 2.

Looking now to the details of FIGS. 2 and 3, in conjunction with other figures of the drawings, it will be noted that a flexible hose 38 is affixed to the connector 20. The connector has a marginal end portion 40 rotatably and sealingly connected to a stationary member 42. A marginal inlet end of the pipe is telescopingly received in sealed relationship within the rotatable portion of the connector.

The outlet connector 22 includes a stationary member 44 which is sealingly connected to a rotatable member 46. Flexible hose 28 supplies high pressure air at 47 so that a venturi device 48 can produce a suction on the outlet end 51 of the pipe. Tube 50 includes the outlet 51 through which products can flow through the pipe 11 and outwardly away therefrom and towards a chute 52. The marginal interior surface at 53 of the pipe 11 disclosed in FIG. 2 has been cleaned, but is devoid of plastic coating. The surface at the marginal inlet end 54 of the pipe has been coated as a result of a pocket 56 of air-entrained plastic particles passing therethrough.

As best seen in FIG. 3, deposition of plastic particles from the pocket 56 adheres to the heated wall surface of the pipe so that a plastic film 54 is formed as the pipe rotates at a velocity dependent upon its size, as for example, 80 to 100 RPM for a 2⅜ inch diameter pipe.

Figure 4:
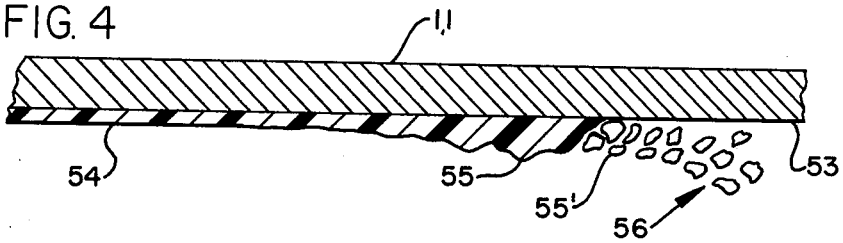
FIG. 4 is an enlarged, fragmented, part diagrammatical, part schematical, longitudinal, part cross-sectional detailed view of part of the apparatus disclosed in FIGS. 2 and 3.

In FIG. 4, the rotating preheated pipe has the before mentioned inside peripheral surface 53 initially coming into contact with the pocket of plastic particles 56. The plastic particles commence touching the pipe wall at 55', and at 55 the particles have commenced melting and adhering to one another. The centrifugal action of the pipe forms the individual particles of plastic into a continuous, uniform film at 54.

Figures 5, 7, 8:
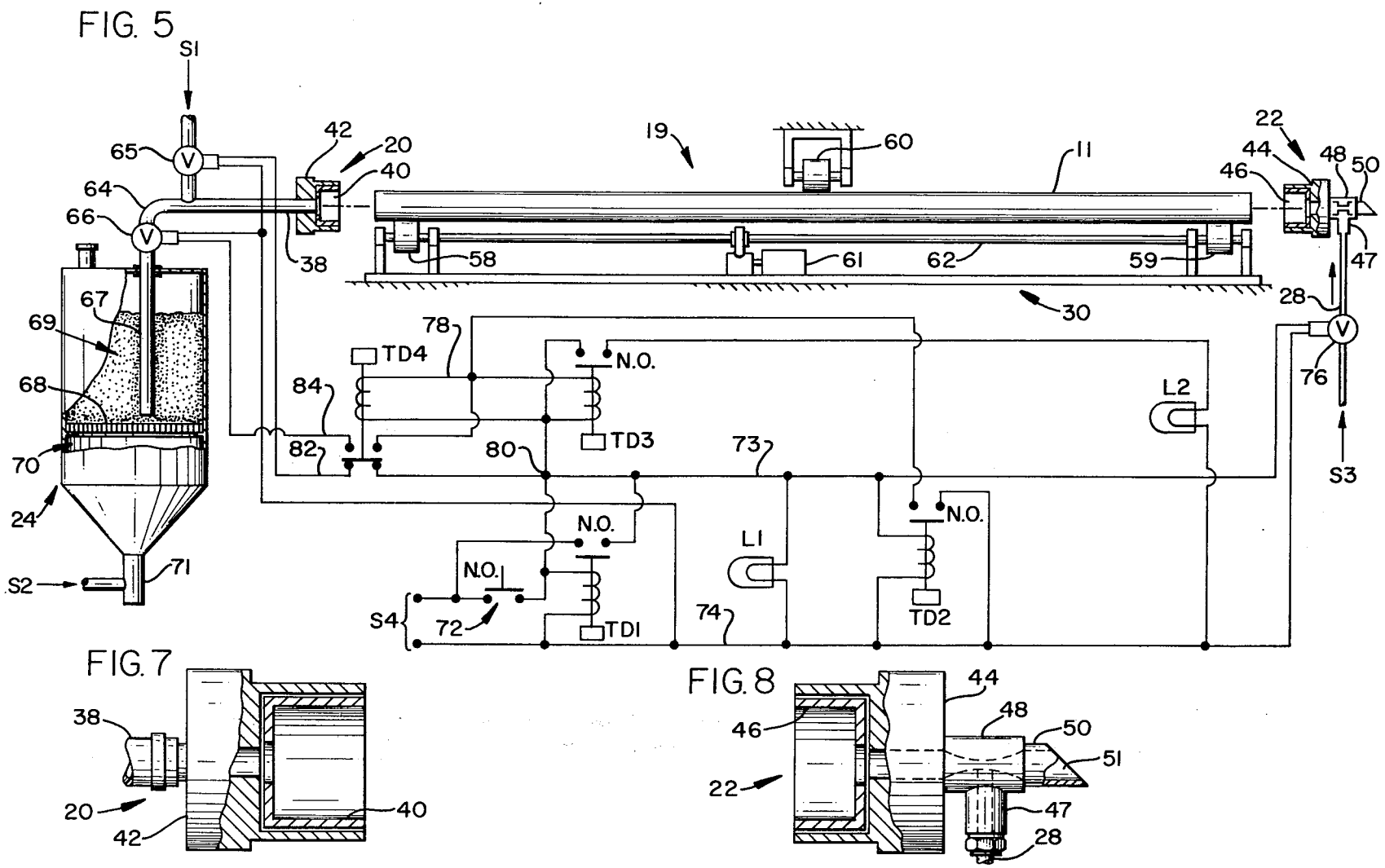
FIG. 5 is an enlarged, detailed, part cross-sectional view of part of the apparatus for use in conjunction with the process disclosed in FIG. 1.
FIGS. 7 and 8 are enlarged, detailed, part cross-sectional views of part of the apparatus disclosed in FIGS. 5 and 6.

The specific embodiment of FIG. 5 illustrates the details of the coating station previously seen at 19 in FIG. 1. The apparatus of FIG. 5 includes roller devices 58, 59, and 60 which are spaced from one another and arranged according to prior art expedients such that a prime mover 61 drives a shaft 62 to thereby spin the pipe at an appropriate rotational velocity. The marginal ends of the pipe are rotatably and sealingly captured by the connector devices 20 and 22 so that fluid flow can be sealingly established from flow conduit 64, through the connector device, through the pipe, through the scavenging or eductor apparatus 22, where the flow products emerge through the outlet tube 50.

Solenoid actuated, normally closed valve 66 controls the flow from standpipe 67 into conduit 64. Fluidized plastic container 24 contains a bed 69 of fluidized plastic, preferably in the form of a polymeric hydrocarbon in particulate form. A pervious baffle 68, such as a porous, synthetic grindstone or a thick sheet of porous beaverboard, separates chamber 70 from chamber 69. Inlet 71 is connected to a regulated source of air pressure S2 so that flow into plenum chamber 70 and across member 68 establishes the fluidized bed 69.

Normally open switch 72 is moved to the closed position in order to actuate time delay holding relay TD1. When the coil of TD1 is actuated, the normally open contacts thereof close for a predetermined time interval, as for example, 7 seconds. This action connects a source of electrical current S4 across conductors 73 and 74, thereby energizing lamp L1, the coil of TD2, and additionally moves the solenoid actuated valve 76 from the normally closed into the open position.

This action simultaneously illuminates light L1 and moves the armature of TD2 such that the normally open switch associated therewith close after a preset time interval. Opening of valve 76 causes a source of compressed air S3 to flow into the eductor 47, thereby producing a low pressure area at the outlet end of the pipe 11.

This action also provides blow air because the closed solenoid actuated valve 65 is energized and moved to the normally open position, while the closed valve 66 remains unenergized and in the closed position. Accordingly, the valves 65 and 66, respectively, are normally opened and normally closed, respectively, when the circuitry of FIG. 5 is in the standby configuration.

The switch at TD2 closes after approximately 1 second of operation and remains closed so long as current is imposed on the solenoid thereof. Closure of the normally open TD2 switch contacts completes the circuitry between conductors 74 and 78, thereby energizing the parallel connected solenoids of TD3 and TD4.

Energization of TD4 immediately moves the contacts thereof to the alternate position, thereby moving the normally open contacts into the closed position while the normally closed contacts are opened. Accordingly, the circuitry at 82 is broken and solenoid 65 moves the flow air valve to its unenergized closed position, thereby discontinuing flow of compressed gas from S1 into 20. At the same time the normally open contacts of TD4 are moved to the closed position, thereby completing the circuitry required to energize and move the closed paint solenoid valve 66 to the open position. Time delay relay 4 will remain in this alternate position for approximately 1 second, depending upon the length and diameter of the pipe undergoing treatment; and therefore for the time interval selected for the desired charge size from 69.

The regulated air flow S-2 is conducted into the before mentioned plenum chamber 70, across the porous member 68, thereby fluidizing the plastic particles at 69, in a manner known to those skilled in the art.

The above action causes the particles of plastic to flow into standpipe 67, through the coupling 20, into the pipe, and towards the outlet end of the pipe. Member 22 effects a suction at the outlet end of the pipe during this operation.

It is desirable to remove the coupling 22 from the outlet end of the pipe after valve 66 closes and valve 65 reopens. Accordingly, TD3 is set to time out after an interval of time which achieves this expedient. Therefore, TD3 is generally set for a time interval of approximately 3/10 second greater than the time interval required of TD4.

Accordingly, TD4 times out, closing paint valve 66 and opening blow air valve 65 to thereby push the pocket of plastic into the pipe. TD3 times out approximately 3/10 second following the time interval of TD4, extinguishing L2 and indicating that the suction or jet member 22 should be removed from the end of the pipe.

The operator at the outlet end of the pipe has ample time in which to manually remove the connector 22 before the remains of the pocket or charge of plastic arrives at the outlet end of the pipe because more than 1 second expires after the paint valve has closed and the blow valve opened which is adequate time for the operator to remove the connector and stand aside.

After member 22 has been removed and the pocket 56 emerges from the outlet, the pipe continues spinning until TD1 times out, thereby completing the work at station 19.

FIGS. 7 and 8 illustrate the details of one configuration which the inlet and outlet couplings 20 and 22 can take on. As seen in FIG. 8, the eductor which produces a suction at the outlet end of the pipe is comprised of the before mentioned stationary and rotatable members. Any number of different expedients can be employed to attain this relative rotational motion. The jet air supply at 47 must be of sufficient velocity and volume respective to the illustrated venturi to produce a sufficiently low pressure at the outlet end of the pipe to produce a flow from the fluidized bed.

The construction of the coupling 20 is similar in some respects to 22, and can take on a number of different forms so long as relative rotational sealed motion is effected between the rotatable and stationary parts of the coupling member.

Figure 6:
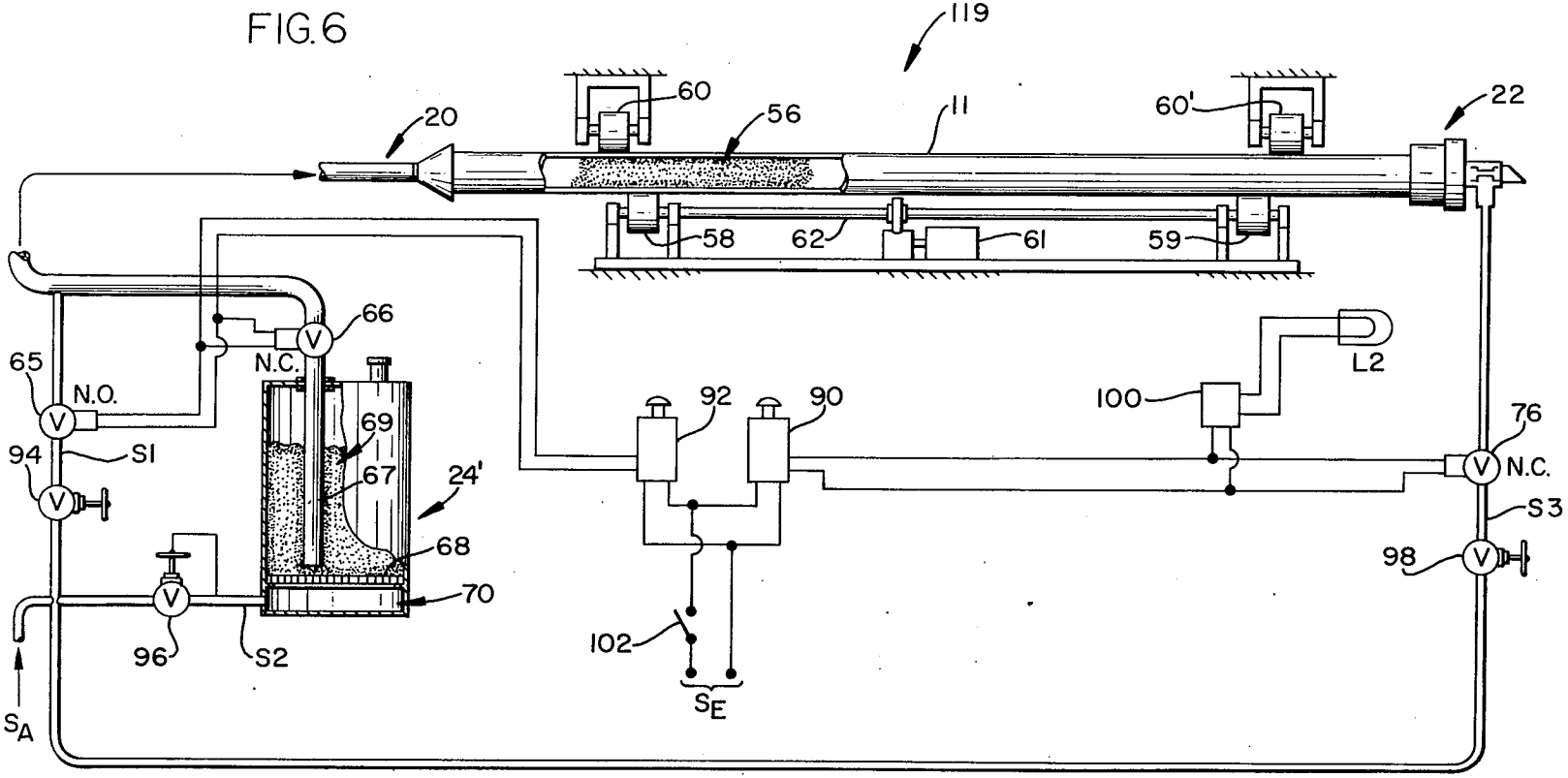
FIG. 6 is similar to FIG. 5 and shows an alternate embodiment thereof.

FIG. 6 exemplifies a simplified embodiment of the control system of the instant process, wherein two manually operated time delay mechanisms 90 and 92 are placed in "side-by-side" relationship and connected to a source of electrical current SE. Regulator 94 provides a regulated air source for the normally open valve 65. Regulator 96 maintains an optimum pressure within chamber 70 so that the pervious baffle 68 admits sufficient flow into the container 24' to effect a rolling or fluidized bed of plastic particles 69. Regulator 98 provides a regulated air source for the normally open solenoid actuated valve 76 to thereby produce the proper suction at the outlet end of the pipe. Time delay means 100 is set to cause light L2 to be extinguished after a preset time.

In FIG. 6, solenoid actuated blow valve 65 is normally open, while the solenoid actuated paint valve 66 is normally closed. Solenoid actuated jet air valve 76 is normally closed. Switch 90, when hit by the palm of the hand, is electrically connected to immediately actuate valve 76, and at the same time to energize time delay relay 100. The time delay relay 100 is set to extinguish light L2 a predetermined time after switch 90 has been manually activated. Switch 90 times out after a preset time which is greater than the time set for the time delay relay 100.

Switch 92 is connected to provide a source of current to the two parallel connected solenoid actuated valves 65 and 66. The switch 92, when hit with the palm of the open hand, immediately actuates the parallel connected solenoids of valves 65 and 66 to simultaneously move valve 65 to the closed position and valve 66 to the open position. After a preset time interval, switch 92 times out, thereby de-energizing the solenoids of valves 65 and 66, and causing the valves to revert to their normal or de-energized configuration.

In operation of the embodiment disclosed in FIG. 6, a source of air is made available at SA. Compressed air flows through regulator 96, into S2, and hence into chamber 70, thereby providing a fluidized bed 69. Regulator 94 provides source S1 for the blow valve 65. Valve 65 is normally open; and therefore, a flow occurs from 94, through 65, and into the member 20, thereby causing compressed air to flow through the pipe as soon as member 20 is manually affixed in a removable manner to the end thereof.

Valve 76 is normally closed; and accordingly, no flow occurs from regulator 98 into the member 22 until the solenoid thereof is energized. Therefore, with the apparatus 119 in the standby configuration of FIG. 6, member 20 will be held by a workman so that a flow of compressed air is forced to travel through the interior of the pipe while member 22, which is likewise held to the outlet end of the pipe by a workman, has no flow from valve 76; and therefore, compressed air from 20 is being forced to flow through member 22.

Switch 102 is moved to the closed position, thereby providing a source of current for the manually actuated time delay relay switches 90 and 92. The operator in charge of the apparatus glances at each workman located at 20 and 22, and the workmen acknowledge his look of inquiry and signify that they are ready to treat the spinning, preheated joint of pipe. The operator next hits switch 90 with the palm of his hand and immediately thereafter hits switch 92 with the palm of his hand, with perhaps 3/10 second expiring between actuation of the two switches.

Actuation of time delay switch 90 energizes time delay relay 100 and energizes the solenoid of normally closed valve 76 causing the valve to open and thereby establishing a suction at member 22. At the same time, the lamp L2 is illuminated as the time delay relay 100 commences to time out. Meanwhile, light L2 is telling the workmen that member 22 should be placed on the outlet end of the pipe immediately, if he has not already done so. Time delay relay 100 has been set to time out before relay 90 times out; therefore, light L2 remains illuminated until time delay relay 100 reaches the end of its time cycle.

Actuation of switch 92 energizes the solenoids of valves 65 and 66. This causes valve 65 to assume the closed position, thereby discontinuing flow from regulator 94 into member 20. Simultaneously, valve 66 is moved to the open position, permitting flow to occur from the bed 69, into the intake pipe 67, though the valve 66 and through the member 20 where the pocket 56 of entrained plastic particles is forced to flow into the pipe.

Timer 92 de-energizes the parallel connected solenoids of valves 65 and 66 approximately 1 second after switch 92 has been actuated. Timer 100 times out approximately 1.3 second after switch 92 has been actuated, thereby informing the operator at 22 to remove the member from the end of the pipe. Hence, timer 92 times out to close valve 66 and open valve 65 about 3/10 second before light L2 is extinguished.

Upon timer 92 timing out, valve 65 returns to the normally open position permitting flow to occur from regulator 94 into member 20, thereby pushing the pocket 56 of entrained plastic particles through the pipe. At this stage of the operation, no further flow occurs into standpipe 67 because valve 66 has assumed the normally closed position.

Light L2 preferably is extinguished in sufficient time to enable the workman to remove the venturi member from the outlet end of the pipe immediately before the remains of pocket 56 arrives at the outlet end of the pipe.

The operator continues to permit the pipe to spin for a few seconds in order to set the plastic lining and thereafter he stops the rotation of the spinning pipe, transfers the treated pipe joint to station 32 of FIG. 1, and immediately thereafter places a new heated pipe from 16 onto the spinning apparatus 58–60. The above described sequence of events is repeated in order to treat another joint of pipe.

The valves 65 and 76 can be an ordinary ¾ inch solenoid actuated control valve which has a relatively quick rate of response. The valve 66 is preferably a ball type valve which is pneumatically actuated by a double acting piston, by utilizing an air reversing solenoid valve made by Verser Valve Company. Line S1 is a ¾ inch diameter conduit. Intake pipe 67 is 1⅞ inch id; conduit 64 is 2 inch id; and conduit 47 is ¾ inch.

EXAMPLE 1.

A 2⅜ inch tubing has been heated slightly above 400° F., the "powder on" timer is set for 1 second, the "vacuum on" timer is set at 6 seconds, and the light signal L2 is set at 1.3 seconds. The "blow air" regulator is set at 34 psi, the vacuum regulator at 61 psi, and the fluid bed regulator at 15 ounces pressure so that the powder assumes a light rolling appearance.

The operational sequence occurs such that the vacuum and blow air come on, and thereafter the paint valve opens while the blow air valve closes. The red light subsequently indicates that the member 22 should be removed. The pipe is rotated for several additional seconds to set the coating, after which the pipe is removed and the ends painted manually so as to preserve the threads.

EXAMPLE 2.

A cleaned 2⅞ inch tubing is preheated to 410° F. and rotated at a speed of 80 to 100 rpm. The blow pressure is set at 42 psi, the air source to create the vacuum at 63 psi, and the powder valve is set to remain open 1.2 seconds. The vacuum air valve is set to remain open 6.5 seconds. The signal to take off member 22 is set at 1.5 seconds.

EXAMPLE 3.

A 2⅜ inch tubing has been cleaned and preheated to 410° F. and is spinning at 80 to 100 rpm. The blow air pressure is set at 34 psi, the vacuum jet air pressure at 61 psi, the powder valve is set to remain open for 1 second, the vacuum air valve is set for 6 seconds, and the "take off vacuum" light signals at the end of 1.3 seconds. The powder used in the above two examples is Corvel 501 powder which is available from The Polymer Company, Reading, Pa.

EXAMPLE 4.

M and T powder (M and T Chemicals, North Post Oak Rd., Houston, Tex.) is charged into the container at 69 and a 2⅞ inch cleaned tubing, which has been heated to 375° F. is rotated at 80–100 rpm. The blow air pressure is set at 34 psi, the vacuum set at 62 psi, the powder valve is opened for 1 second, the vacuum air valve is open for 6 seconds, and the signal to remove the vacuum is set for 1.3 seconds.

In each of the above examples of the present invention, it is necessary for air to be blowing through the preheated pipe while the pipe is rotated at a suitable velocity to spread the melted plastic into a continuous uniform film about the interior thereof. The vacuum at 22 is always applied to the outlet and of the pipe prior to opening of the paint valve 66. The blow valve 65 is always closed simultaneously with the opening of the paint valve 66 so that there is substantially no interruption in the continuous flow through the pipe. This expedient takes advantage of the momentum of the mass flow of the material established by the blow valve 66 so as to augment the efforts of the vacuum at 22 in order to ingest the entrained plastic particles into the standpipe 67 and translocate the charge into the pipe as diagrammatically illustrated at 56 in FIG. 6. The size of the charge 56 is regulated by adjustment of the time delay interval of valve 66. Furthermore, it is essential that valve 65 open simultaneously with the closing of valve 66 so as to push the pocket 56 through the pipe and towards the vacuum source 22.

The vacuum source 22 is removed from the end of the pipe just before any plastic particles can emerge therefrom. The pocket of entrained plastic particles 56 becomes heated as it travels through the hot spinning pipe 11. Moreover, member 22 becomes heated because of the hot compressed air flowing therethrough. Should member 22 remain attached to the end of the spinning pipe, it rapidly becomes coated with plastics and its efficiency diminishes.

The surplus plastic 56 emerging from the end of the pipe can be received in any type open or closed container and accumulated for re-use, if desired. This is a matter of economics and housecleaning, and does not touch on the merits of the operation of the process.

The powder on valve 66 is a Jamesbury 2 inch ball valve, model C, which is actuated by a Versa solenoid, type A, #XB584383, 120v 60 cycles; which receives a pneumatic signal from a Jamesbury ST-20 and ST-50 air actuator.

The blow air valve 65 and the jet air valve 76 are manufactured by Automatic Smith Company, #649715, Catalog #8210A3 and includes a ¾ inch orifice therein.

The TDR 90 and 92 are Allen Bradley Pneumatic timing units described in Bulletin 1496, January, 1973, Allen Bradley Industrial Control Division, Milwaukee, Wis., 53204.

Where deemed desirable, a prime coat of material can be applied to the interior of the pipe prior to the application of the plastic particles. For example, a prime coating of NAPKO, #77N144 (NAPKO Corporation of Houston, Tex.) can be used to advantage in conjunction with the present invention.

I claim:

1. Apparatus for coating the interior of a pipe with a continuous layer of plastic by preheating the pipe and thereafter flowing particulated synthetic polymeric material from a fluidized bed into the interior of the preheated pipe while the pipe is being rotated, comprising:

means, including an enclosure, within which a fluidized bed of polymeric material is formed; support means for rotatably supporting a pipe about its axial centerline while polymeric material flows thereinto; a preheating means by which the temperature of the pipe can be elevated, means for transferring the pipe into the preheating means and from the preheating means onto the support means;

a main flow conduit including means by which one end thereof is connected to receive flow of polymeric material from the fluidized bed contained within said enclosure; an inlet connector means for removably connecting the other end of said main flow conduit to one end of the pipe; a paint valve means connected for controlling flow from the fluidized bed contained within said enclosure into said main flow conduit; means, including a blow air control valve, by which a source of air pressure is connected to said main flow conduit at a location downstream of said paint valve to provide flow of air into said flow conduit at a location between said paint valve and said connector, so that said blow air control valve controls flow of air from said source of air pressure and into said main flow conduit;

means forming an outlet connector which can be removably connected to the other end of the pipe, a suction means associated with said outlet connector by which reduced pressure is effected within the pipe when said outlet connector is affixed thereto;

means by which said blow air valve is opened when said paint valve is closed, and vice versa;

indicator means connected to said means by which said blow air valve is opened when said paint valve is closed, thereby signaling that a charge of polymeric material is contained within the pipe and therefore the outlet connector should be removed from the other end of the pipe;

whereby a pipe can be moved into the preheating means where the temperature of the pipe is elevated, and thereafter the pipe is mounted for rotation on the support means, the inlet connector is connected to one end of the preheated pipe and the outlet connector is connected to the other end of the preheated pipe with the blow air flowing into one end of the pipe and a suction applied to the other end thereof, whereupon the blow air valve is closed while the paint valve is simultaneously opened while the suction is continued thereby causing a charge from the fluidized bed of polymeric material to move into and coat the interior of the rotating pipe, and the position of the valves thereafter is reversed to push the charge of plastic through the interior of the pipe.

2. The apparatus of claim 1 wherein said blow air valve is a normally open solenoid actuated valve, said paint valve is a normally closed solenoid actuated valve; switch means, including circuitry, by which the solenoid of said blow air valve is caused to close said blow air valve while simultaneously the solenoid of said paint valve is caused to open said paint valve for a time interval during which the charge of polymeric material from the fluidized bed can be forced into the main flow conduit, and said switch means thereafter causes the solenoids to close the paint valve while simultaneously the blow air valve is opened to thereby discontinue the flow of polymeric material from the fluidized bed into the main flow conduit and commence blowing the charge of polymeric material through the interior of the pipe.

3. The apparatus of claim 1 wherein said blow air valve and said paint valve each include a solenoid by which they are actuated; a time delay device; a start switch;

means, including circuitry, connecting each said solenoid and said time delay device together such that actuation of said start switch which causes the solenoid of the blow air valve to move the last said valve to the open position so that a flow of air into said main conduit occurs for a first time interval, and thereafter, the solenoid of the blow air valve causes the last said valve to be closed while the solenoid of the paint valve is actuated to cause the paint valve to be opened for another time interval, after while said blow air valve is again opened while said paint valve is again closed, thereby blowing the charge of polymeric material through the pipe.

4. The apparatus of claim 1 wherein said blow air valve and said paint valve are each a solenoid actuated valve; a time delay device; a start switch;

means, including circuitry, by which said start switch, solenoids, and time delay device are connected such that actuation of the start switch causes the solenoid of the blow air valve to open, whereupon a flow of air occurs to said main conduit for a first time interval, and thereafter, the last said solenoid causes the blow air valve to be closed while the solenoid of the paint valve causes the paint valve to be opened for another time interval after which said blow air valve is again opened while said paint valve is again closed, thereby blowing the charge of polymeric material through the pipe;

said suction means includes a venturi for producing a low pressure, a solenoid actuated venturi air supply valve connected to said venturi for effecting flow of air therethrough; said means, including circuitry, being connected to said means which operates said blow air valve and said paint valve to cause said indicator means to signal when said charge of polymeric material is contained within the pipe.

5. Apparatus for coating the interior of tubular goods, comprising:

means for rotating a preheated pipe about the longitudinal centerline thereof;

means forming an enclosure which includes apparatus by which a dry fluidized bed of plastic can be formed therewithin;

a source of compressed gas at a relatively high pressure above atmospheric pressure, a source of reduced pressure at a relatively low pressure below atmospheric pressure;

an inlet connector which can be removably affixed to one end of said preheated pipe when the pipe is rotatably supported;

an outlet connector which can be removably connected to the other end of the rotating pipe, means connected to said source of reduced pressure and said outlet connector by which reduced pressure is effected within the last said pipe when the outlet connector is affixed thereto;

conduit means connecting said inlet connector to said enclosure and to said source of compressed gas, a blow valve means interposed in said conduit means between said source of compressed gas and said inlet connector for controlling flow of compressed gas into said inlet connector; a paint valve means interposed between said enclosure and said inlet connector for controlling flow of fluidized plastic from said fluidized bed into said inlet connector;

means for simultaneously closing said blow valve means while opening said paint valve means and thereafter closing said paint valve means while simultaneously opening said blow valve means so that a charge of plastic can be forced to flow from the enclosure, through the inlet connector, and into the rotating preheated pipe;

said outlet connector is connected to the other end of the pipe for effecting said reduced pressure within the pipe while said paint valve is open;

indicator means connected to provide a signal in response to actuation of said paint and blow valve means which indicates that a charge of plastic has been transferred from said enclosure and is in the act of traveling towards the other end of the pipe so that the outlet connector can be removed from said other end of the pipe before the charge of plastic reaches the outlet connector.

6. In a coating apparatus having means for heating a pipe and rotating the heated pipe, and a fluidized bed apparatus having a chamber therein for containing a fluidized bed of plastic particles, a source of high pressure blow air, a vacuum source, and inlet connector for being removably attached to one end of the pipe, and an outlet connector for being removably attached to the other end of the pipe, the improvement comprising:

means, including a paint valve, connector to control flow from said chamber to said inlet connector; means, including a blow air valve, connected to control the flow of said source of high pressure blow air to said inlet connector;

means for opening said paint valve while simultaneously closing said blow air valve, and vice versa;

means flow connecting said outlet connector to said vacuum source;

indicator means connected to provide a signal which indicates that said paint valve has closed after a charge from said fluidized bed has been transferred into said inlet connector so that said outlet connector can be removed from the other end of the pipe; said indicator means being connected to provide said signal in response to said paint valve and said blow valve, respectively, having been moved to the closed and open position, respectively, after having been positioned in the open and closed position, respectively;

whereby, said blow air valve can be opened to establish a flow of blow air through the inlet connector and into the rotating hot pipe while said outlet connector augments the flow therethrough due to the vacuum, whereupon, said paint valve can be opened while said blow air valve is simultaneously closed to thereby cause the vacuum at the outlet connector to cause a flow of plastic material to occur from the fluidized bed into the pipe, and thereafter said paint valve is closed while said blow air valve is opened to cause the plastic particles in the conduit to continue to flow into the pipe; and said outlet connector can be removed from the outlet end of the pipe prior to the charge reaching the outlet connector.

7. The apparatus of claim 6 wherein said blow air valve and said paint valve are each a solenoid actuated valve, said paint valve is held closed by the solenoid thereof while said blow air valve is held open by the solenoid thereof; switch means, including circuitry, by which the solenoid of said blow air valve is caused to close said blow air valve while simultaneously the solenoid of said paint valve is caused to open said paint valve for a time interval which enables the charge of plastics from the fluidized bed to be forced into the inlet connector, and said switch means thereafter causes the solenoids to close the paint valve while simultaneously the blow air valve is opened to thereby discontinue the flow of plastic from the fluidized bed into the inlet connector and commence blowing the transferred plastic material through the interior of the pipe.

8. The apparatus of claim 6 wherein said blow air valve and said paint valve are each a solenoid actuated valve; a time delay device; a start switch; means, including circuitry, by which said start switch and time delay device are connected to cause the solenoid of the blow air valve to open said blow air valve to thereby flow air into said inlet connector for a first time interval and thereafter, the last said solenoid moves the blow air valve to the closed position while the solenoid of the paint valve is actuated to cause the paint valve to be opened for another time interval after which said blow air valve is again opened while said paint valve is again closed, thereby blowing the transferred plastic material through the pipe.

9. The apparatus of claim 6 wherein said vacuum source includes a venturi for producing a low pressure, a solenoid actuated venturi air supply valve connected to said venturi for effecting flow of air therethrough; said indicator means is connected to said means which operates said blow air valve and said paint valve to cause said indicator means to signal that the transferred plastic material is contained within the pipe and therefore, the suction means should be removed from the other end of the pipe.

* * * * *

UNITED STATES PATENT OFFICE

CERTIFICATE OF CORRECTION

Patent No. 4,122,798 Dated October 31, 1978

Inventor(s) JACK E. GIBSON

It is certified that error appears in the above-identified patent and that said Letters Patent are hereby corrected as shown below:

Column 2, line 32, "to" should read --by--;

Column 5, line 31, insert --will-- after "therewith";

Column 9, line 18, "and" should read --end--;

Column 12, Claim 6, line 38, "connector" should read --connected--.

Signed and Sealed this

*Tenth* Day of *April 1979*

[SEAL]

*Attest:*

RUTH C. MASON
*Attesting Officer*

DONALD W. BANNER
*Commissioner of Patents and Trademarks*